US007252059B2

(12) United States Patent
Abbott et al.

(10) Patent No.: US 7,252,059 B2
(45) Date of Patent: Aug. 7, 2007

(54) CLOSURE ASSEMBLY FOR A CAMSHAFT PHASER

(75) Inventors: Larry G. Abbott, Honeoye Falls, NY (US); David M. McCarthy, Churchville, NY (US); Peter R. Charles, Rochester, NY (US); John J. Krieg, Spencerport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/130,501

(22) Filed: May 17, 2005

(65) Prior Publication Data

US 2006/0260576 A1 Nov. 23, 2006

(51) Int. Cl.
*F01L 1/34* (2006.01)

(52) U.S. Cl. ..... 123/90.17; 123/90.15; 123/90.37; 123/90.38; 123/195 C; 70/158; 70/182; 137/383

(58) Field of Classification Search ..... 123/90.17
See application file for complete search history.

(56) References Cited

U.S. PATENT DOCUMENTS 2,032,879 A * 3/1936 Jezler ..... 215/272
3,517,951 A * 6/1970 Dunmire ..... 285/110
5,172,999 A * 12/1992 Ijima et al. ..... 403/51
6,390,042 B1 * 5/2002 Scott et al. ..... 123/90.17
6,802,289 B2 * 10/2004 Miyazaka et al. ..... 123/90.17

* cited by examiner

*Primary Examiner*—Thomas Denion
*Assistant Examiner*—Kyle M. Riddle
(74) *Attorney, Agent, or Firm*—Paul L. Marshall

(57) ABSTRACT

A closure assembly for a camshaft phaser. A plug or a cap is provided with either a radially-sealing gasket seal or a face-sealing gasket seal, the seal being formed by insertion of the plug into a bore, or by installation of a cap over a neck formed in a cover plate. The closure is provided with a plurality of spaced-apart locking elements, and the plate is provided with a plurality of spaced-apart, radially extending second locking elements in the form of fingers surrounding a central opening. During assembly, the closure is mated to the plate with the first locking elements interspersed with the second locking elements. The closure is rotated to bring the locking elements into locking engagement with each other, preventing counter-rotation of the closure. No threads or torque specifications are required.

1 Claim, 4 Drawing Sheets

CLOSURE ASSEMBLY FOR A CAMSHAFT PHASER

TECHNICAL FIELD

The present invention relates to camshaft phasers for varying the valve timing of internal combustion engines; more particularly, to means for closing a camshaft phaser after assembly to the engine; and most particularly, to an assembly including a twist-lock closing and locking mechanism for retaining a sealing plug or cap in a non-threaded bore in a camshaft cover plate.

BACKGROUND OF THE INVENTION

Camshaft phasers for varying the timing of valves in internal combustion engines are well known. A typical phaser comprises a stator that is connected with the cam drive system driven by the engine crankshaft and a rotor within the stator connected to the camshaft. The phaser is able to vary the rotary position of the rotor with respect to the stator and thus to vary the valve timing imposed on the camshaft with respect to the crankshaft and pistons.

A prior art camshaft phaser is closed by a threaded metallic plug and an O-ring that seals on a tapered face just inside the bore. The threaded plug is screwed into a threaded cover. The plug is torqued to a required specification, but the torque level is expected to stay above the minimum required specification during thermal cycling, otherwise the plug could loosen and disengage during the life of the engine. A loosened plug or an opened phaser could cause unacceptable leakage negatively effecting operation of the phaser, a failure of the drive belt, unacceptable loss of engine oil pressure, and external oil leaks.

What is needed in the art is an improved closure assembly for a camshaft phaser wherein a plug or cap is sealingly retained in a phaser opening without threads or torquing and no compromise in retention capability during use of the phaser.

It is a principal object of the present invention to prevent disengagement and leakage of a closing plug or cap on a camshaft phaser.

SUMMARY OF THE INVENTION

Briefly described, a plug or cap closure in accordance with the invention is provided with either a radially-sealing or a face-sealing resilient element, for example, an O-ring, the seal being formed by insertion of a plug into a non-threaded bore, or by installation of a cap over a non-threaded neck, formed in a phaser cover plate. The seal may be formed against the bore or neck, which may be tapered to compress the O-ring, or may be formed against an axial face of the plate. Either the plate or the closure is provided with a plurality of spaced-apart, peripheral locking elements, and conversely, either the closure or the plate is provided with a matching plurality of spaced-apart latching elements referred to herein as "fingers". During assembly, the plug is inserted axially into the bore, or the cap is installed over the neck, with the locking elements interspersed with the fingers. The axial motion serves to compress a seal element, such as the O-ring, to form a seal between the plug or cap and the plate. The closure is then rotated a fraction of a turn to bring the locking elements into engagement with the fingers. The locking elements and fingers are configured axially such that pressure is maintained on the seal element during such rotation. The locking elements are provided with means for preventing both over-rotation and counter-rotation of the closure, thus ensuring a permanent seal.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
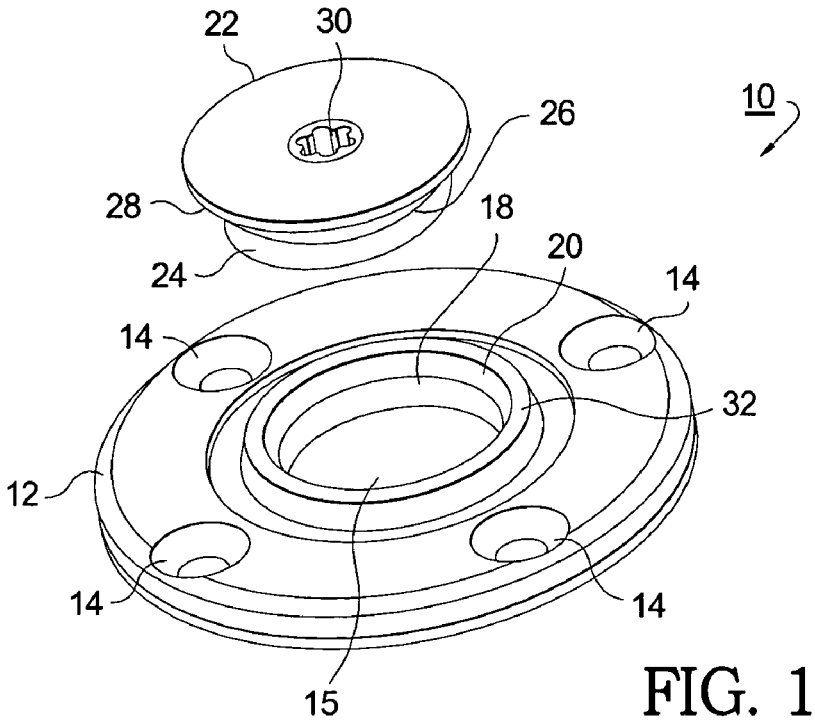
FIG. 1. (PRIOR ART)
FIG. 1 is an exploded isometric view of a prior art phaser cover plate and threaded plug.
Figure 2:
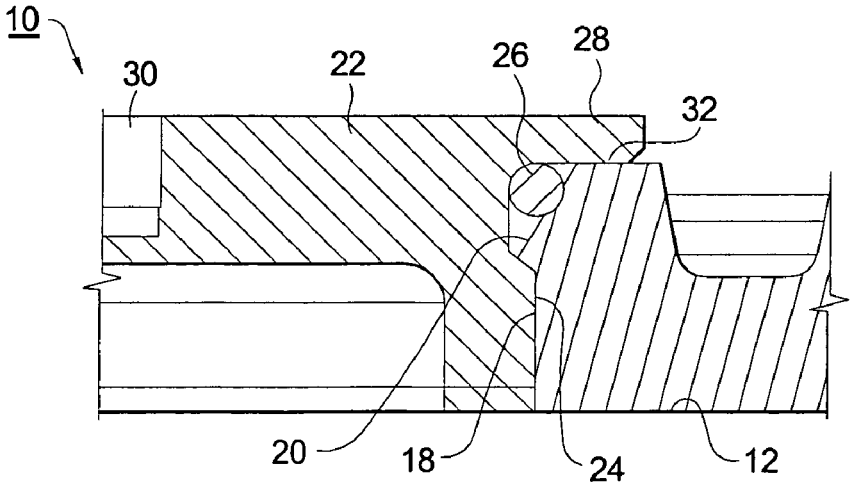
FIG. 2. (PRIOR ART)
FIG. 2 is a cross-sectional view of the prior art plug assembly shown in FIG. 1.

Referring to FIGS. 1 and 2, a prior art closure assembly 10 for a camshaft phaser comprises a phaser cover plate 12 secured generally to the phaser stator (not shown) by bolts (not shown) extending through chamfered boltholes 14. A central opening 15 in plate 12 includes a threaded portion 18 and a smooth tapered portion 20. A solid metal plug 22 has mating threads 24 for engaging threaded portion 18. An O-ring seal 26 is captured by a flange 28 on plug 22 and is sealingly urged against tapered portion 20 as the plug is screwed into the opening. A central feature 30 in the plug permits a tool to be engaged to drive the plug to a predetermined torque when flange 28 engages a lip 32 on plate 12. As described above, the integrity of the seal formed by O-ring seal 26 depends upon maintaining the frictional contact between flange 28 and lip 32, and the jam contact between threads 18,24, or else the plug may unscrew and loosen spontaneously during use of the phaser.

Figure 3:
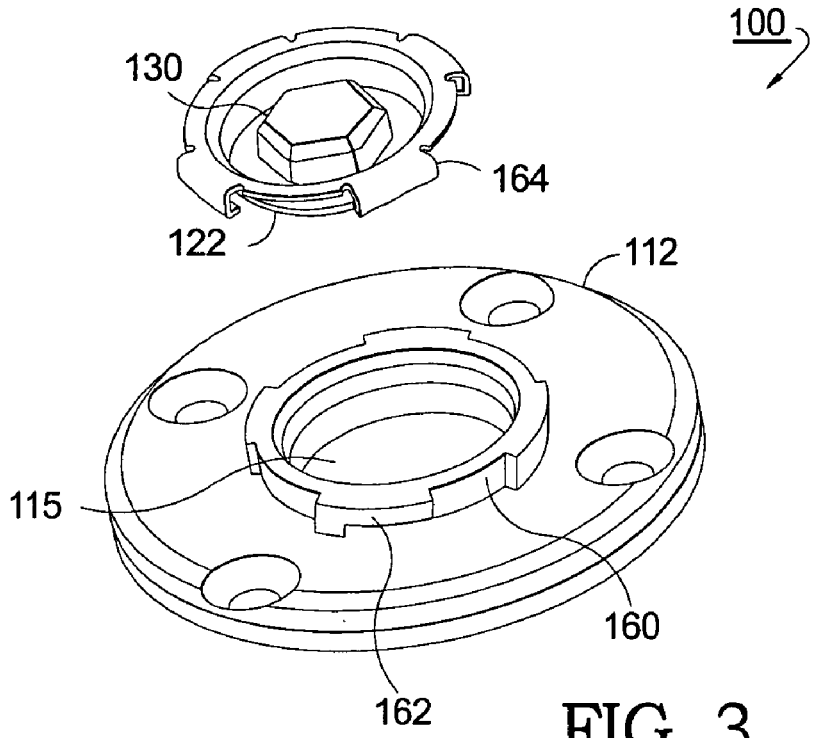
FIG. 3 is an exploded isometric view of a first embodiment of a phaser closure assembly in accordance with the invention.
Figure 4:
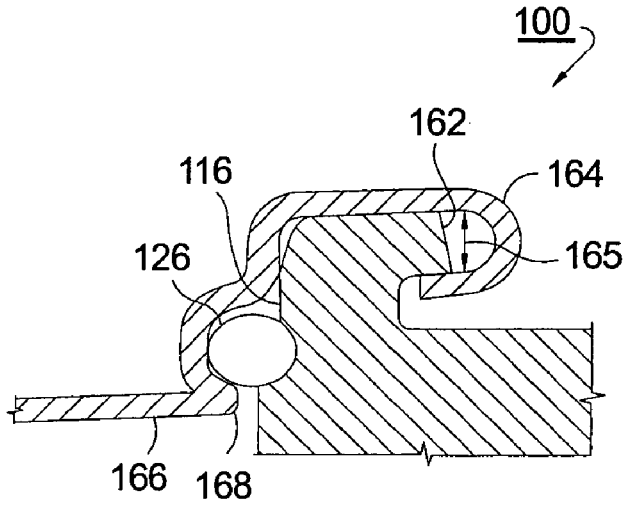
FIG. 4 is a cross-sectional view of the novel closure assembly shown in FIG. 3.

Referring to FIGS. 3 and 4, a first embodiment 100 of a closure assembly in accordance with the invention includes a cover plate 112 similar to prior art cover plate 12 and replaceable thereof. A closure in the form of a male plug 122 is provided with a radially-sealing resilient element, for example, an O-ring 126, the seal being formed by insertion of closure 122 into a non-threaded bore 116 such that O-ring 126 is radially compressed outwards against bore 116. Plate 112 is provided with central opening 115 and an axially-extending neck 160 supporting a plurality of first spaced-apart, peripheral locking projection elements 162. Closure 122 is provided with a matching plurality of second spaced-apart, radially-rigid, recurved latching projection elements 164 referred to herein as "fingers". During assembly, the closure 122 is inserted axially into the bore with the locking projection elements 162 interspersed with fingers 164. The axial motion serves to compress the O-ring to form a seal between the closure and the neck. The closure is then rotated a fraction of a turn to bring the locking projection elements into locking engagement with the fingers. Preferably, either the locking projection elements or fingers are configured axially with increasingly tapered ramps such that the fingers are stretched over the locking projection elements in the direction shown as 165 as the closure is rotated, to always grip the locking projection elements in tension. Thus, pressure is maintained on the seal element during such rotation and the closure is kept rotationally in place thereafter. The locking projection elements are provided with rigid tips 167 for preventing both over-rotation and counter-rotation of the closure, thus ensuring a proper seal. An O-ring gland 166 is incorporated in the closure within its outer diameter. O-ring 126 is retained during the assembly process by a lip 168 created by a stamping operation which deforms the bottom of closure 122. A further feature 130 is also stamped into closure 122 to permit a tool to be engaged to drive closure 122 both axially and rotationally during assembly.

Figure 5:
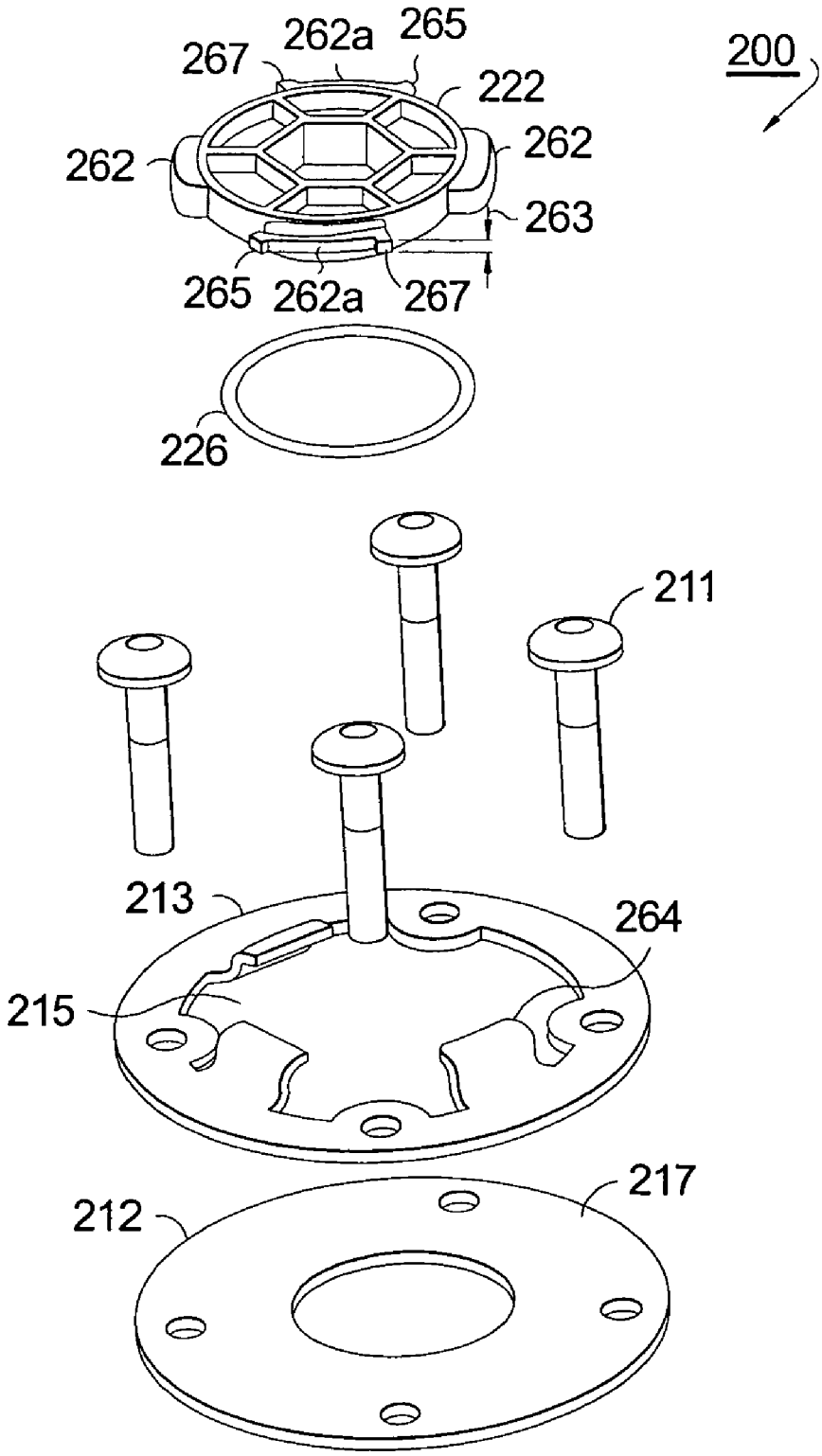
FIG. 5 is an exploded isometric view of a second embodiment of a phaser closure assembly in accordance with the invention.
Figure 6:
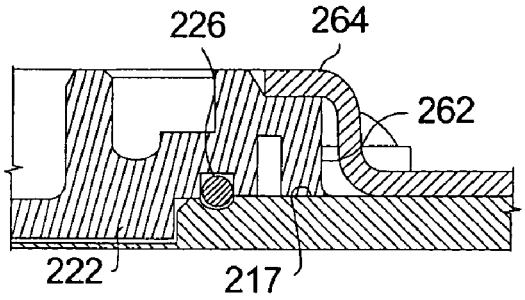
FIG. 6 is a first cross-sectional view of a portion of the second embodiment shown in FIG. 5, showing a first alternative axial O-ring seal.
Figure 7:
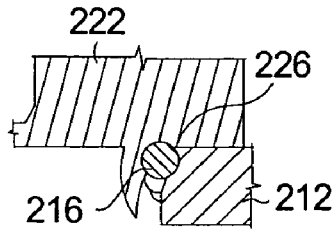
FIG. 7 is a second cross-sectional view of a portion of the second embodiment shown in FIG. 5, showing a second alternative radially-outward O-ring seal.

Referring to FIGS. 5 through 7, in a second embodiment 200 of a closure assembly in accordance with the invention, unlike first embodiment 100, the locking projection elements are incorporated in the closure and slide into and through the fingers. Embodiment 200 includes a base plate 212 similar to prior art cover plate 12 and a locking plate 213 having a large central opening 215 surrounded by a plurality of spaced-apart, radially-rigid, inwardly-recurved fingers 264. Plates 212,213 are secured to a phaser stator (not shown) by bolts 211. A closure in the form of a male plug 222 is provided with a sealing resilient element, for example, an O-ring 226, the seal being formed in either of two ways: by insertion of closure 222 into a preferably tapered non-threaded bore 216 in base plate 212 such that O-ring 226 is radially compressed outwards against bore 216 (as shown in FIG. 7), or by axial compression of O-ring 226 against a mating surface 217 of base plate 212 (as shown in FIGS. 5 and 6). Closure 222 is provided with a plurality of radially extending locking projection elements 262, preferably having at least a portion of width 263 increasingly tapered (from left to right in FIG. 5). Initial axial motion of closure 222 against base plate 212 serves to compress the O-ring to form a seal between the closure and base plate. The locking projection elements then become axially full-fitting within fingers 264, as the closure is rotated, such that compression of O-ring 226 is maintained during and after rotation of the closure to engage the locking projection elements with the fingers. Preferably, at least one of the locking projection elements 262 includes a rotational locking mechanism 262*a* (shown as two opposed elements in FIG. 5) comprising a radially flexible first tip 265 for permitting mechanism 262*a* to enter a finger 264 and a radially rigid second tip 267 for limiting the rotation of closure 222. Tips 265,267 are spaced apart sufficiently that, during rotation of closure 222, when a finger 264 arrives at second tip 267, first tip 265 has exited the finger and snapped radially outwards, thus locking the closure against further rotation in either direction. The closure may be unlocked and counter-rotated for removal by depressing first tip(s) 265 radially inwards until they clear finger 264.

Figure 8:
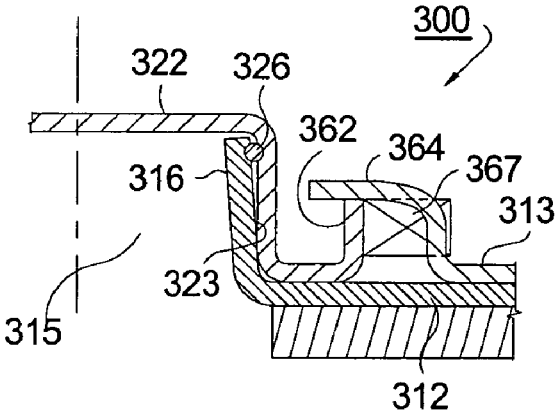
FIG. 8 is a cross-sectional view of a third embodiment of a phaser closure assembly in accordance with the invention.
Figure 9:
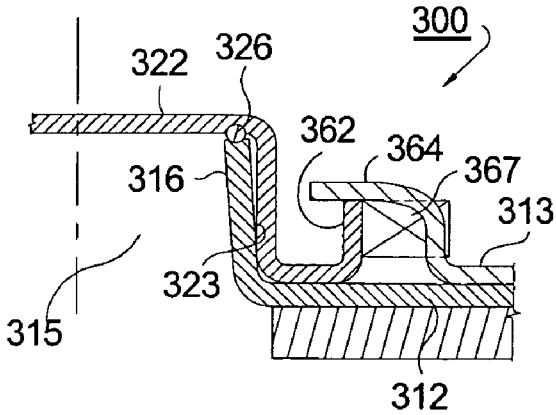
FIG. 9 is a cross-sectional view showing an alternate seal used in the embodiment shown in FIG. 8.

Referring to FIGS. 8 and 9, a third embodiment 300 of a closure assembly in accordance with the invention includes locking projection elements that slide into and through the fingers, as in embodiment 200. The difference from embodiment 200 is that the seal is formed on either the outside (FIG. 8) of a neck or on the end (FIG. 9) of a neck formed in the base plate.

Embodiment 300 includes a base plate 312 similar to prior art cover plate 12 and a locking plate 313 having a central opening 315 and a plurality of spaced-apart, radially-rigid, inwardly-recurved fingers 364 raised as by stamping from locking plate 313, similar to fingers 264 in locking plate 213. A closure in the form of a cap 322 is provided with a sealing resilient element, for example, a gasket or O-ring 326, the seal being formed in either of two ways: by insertion of closure 322 onto the outer surface 323 of a preferably tapered non-threaded neck 316 formed in base plate 312 such that gasket 326 is radially compressed inwards against neck 316 (as shown in FIG. 8); or by axial compression of gasket 326 against an axial end 317 of neck 316 (as shown in FIG. 9). Closure 322 is provided with a plurality of radially extending locking projection elements 362. Preferably, as described in regard to FIGS. 5-7, locking projection elements 362 are configured having at least a portion of their widths increasingly tapered to cause the locking projection elements 362 to be axially full-fitting within fingers 364 such that compression of gasket 326 is maintained during and after rotation of the closure to engage the locking projection elements with the fingers. Preferably, at least one of the locking projection elements 362 includes a rigid tip 367 functionally identical with tip 267 as shown in FIG. 5, to thereby limit over rotation of closure 322.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claim is:

1. A closure assembly for a camshaft phaser, comprising:

a) a plate having a central opening and supportive of a plurality of circumferentially spaced-apart first projection elements surrounding said central opening;

b) a closure extending across said central opening and supporting a plurality of circumferentially spaced-apart second projection elements disposed along the periphery of said closure; and c) a seal disposed between said plate and said closure for preventing fluid leakage therebetween, wherein said first and second projection elements are lockably associated by coaxial rotation of said plate and said closure with respect to one another through a portion of a full revolution, wherein at least one of said plurality of circumferentially spaced-apart second projection elements includes a rotational locking mechanism, and wherein said rotational locking mechanism includes a radially flexible first tip and a radially rigid second tip.

* * * * *